US009004807B2

(12) United States Patent
Slagel

(10) Patent No.: US 9,004,807 B2
(45) Date of Patent: Apr. 14, 2015

(54) TRANSPORTABLE VEHICLE ACCESS CONTROL SYSTEM

(75) Inventor: David Slagel, Flatwoods, KY (US)

(73) Assignee: Modular Security Systems, Inc., Ironton, OH (US)

( * ) Notice: Subject to any disclaimer, the term of this patent is extended or adjusted under 35 U.S.C. 154(b) by 0 days.

(21) Appl. No.: 13/428,878

(22) Filed: Mar. 23, 2012

(65) Prior Publication Data

US 2012/0243936 A1 Sep. 27, 2012

Related U.S. Application Data

(60) Provisional application No. 61/466,779, filed on Mar. 23, 2011.

(51) Int. Cl.

| | |
|---|---|
| ***E01F 1/00*** | (2006.01) |
| ***E04H 1/12*** | (2006.01) |
| ***E01F 13/06*** | (2006.01) |

(52) U.S. Cl.

CPC ..... *E01F 1/005* (2013.01); *E04H 1/1227* (2013.01); *E01F 13/06* (2013.01)

(58) Field of Classification Search

CPC ..... E01F 9/0175; E01F 9/0124; E01F 9/0126; E01F 13/00; E01F 13/06; E01F 13/048; E01F 15/148

USPC ..... 404/6, 9, 10; 49/49; 116/63 C, 63 R, 116/63 P; 40/607.02, 607.06, 607.07, 607.1, 40/608; 340/908

See application file for complete search history.

(56) References Cited

U.S. PATENT DOCUMENTS

| | | | | | |
|---|---|---|---|---|---|
| 2,528,790 | A | * | 11/1950 | Scherer | 235/99 A |
| 2,906,505 | A | * | 9/1959 | Orr et al. | 256/1 |
| 3,641,314 | A | * | 2/1972 | Abramson | 235/378 |
| 4,364,200 | A | * | 12/1982 | Cobb | 49/192 |
| 4,630,395 | A | * | 12/1986 | Nasatka | 49/49 |
| 4,681,479 | A | * | 7/1987 | Wagner et al. | 404/6 |
| 4,893,119 | A | * | 1/1990 | Nasatka | 340/928 |
| 5,069,143 | A | * | 12/1991 | Bunger | 108/57.2 |
| 5,136,810 | A | * | 8/1992 | DeWitt, III | 49/49 |
| 5,700,106 | A | * | 12/1997 | Young et al. | 404/8 |
| 6,796,084 | B2 | * | 9/2004 | Gagnon | 49/226 |
| 6,984,088 | B1 | | 1/2006 | Krivoy | |

(Continued)

OTHER PUBLICATIONS

Par-Kut STD-005 Specification Sheet, Mar. 29, 2009.*

(Continued)

*Primary Examiner* — Abigail A Risic

(74) *Attorney, Agent, or Firm* — James R. Eley; Eley Law Firm Co, LPA

(57) ABSTRACT

A vehicle access control system includes an elongate, generally hollow, generally planar base platform having a first and a second distal end. A generally hollow enclosure is atop the base platform. A first lift gate is intermediate the enclosure and the first distal end of the base platform, while a second lift gate is intermediate the enclosure the second distal end of the base platform. A first lift arm is pivotally coupled to the first lift gate and extends generally perpendicularly away from a longitudinal axis of the base platform. Likewise, a second, opposing lift arm is pivotally coupled to the second lift gate and extends generally perpendicularly away from the longitudinal axis of the base platform. The base platform is configured for direct contact with a mounting surface. In addition, the vehicle access control system is transportable as a unit.

19 Claims, 3 Drawing Sheets

(56) References Cited

U.S. PATENT DOCUMENTS

| | | | | |
|---|---|---|---|---|
| 7,268,701 | B2 * | 9/2007 | Rohl | 340/908 |
| 7,481,598 | B2 * | 1/2009 | Jankovsky | 404/6 |
| 7,818,920 | B2 * | 10/2010 | Causey et al. | 49/49 |
| 8,439,594 | B1 * | 5/2013 | Clark et al. | 404/6 |
| 2004/0091315 | A1 * | 5/2004 | Yodock et al. | 404/6 |
| 2007/0068079 | A1 * | 3/2007 | Morgan et al. | 49/49 |
| 2007/0126598 | A1 * | 6/2007 | Carter et al. | 340/908 |
| 2007/0223995 | A1 * | 9/2007 | Nasatka | 404/6 |
| 2008/0148637 | A1 * | 6/2008 | Pate | 49/49 |
| 2009/0097957 | A1 * | 4/2009 | Cramer et al. | 414/801 |
| 2009/0113828 | A1 * | 5/2009 | Radu, Jr. | 52/380 |
| 2010/0111602 | A1 * | 5/2010 | Yodock et al. | 404/6 |

OTHER PUBLICATIONS

Par-Kut Standard, Product Page for Model STD-005. 2011.
SheltersDirect, Product Page depicting Portable Guard Booths. 2011.

* cited by examiner

TRANSPORTABLE VEHICLE ACCESS CONTROL SYSTEM

This application claims priority to U.S. provisional application 61/466,779, filed Mar. 23, 2011, the contents of which are hereby incorporated by reference.

FIELD

The invention relates generally to gates, guardhouses, traffic islands and movable barriers used to regulate vehicle and pedestrian traffic through a control locus. In particular, the present invention relates to a prefabricated, transportable, self-contained traffic island and vehicular access control point that can be rapidly deployed and installed as a single, integral unit or modular sections.

BACKGROUND

Increased security measures and the frequent need to prevent or otherwise control the flow of traffic trough a specific access points are growing concerns. Such areas as construction sites, governmental buildings, utility facilities, nuclear facilities, parking lots and private residential areas are just a few of the applications where traffic control measures may be desirable. Effective traffic control enables unwanted vehicular traffic to be turned away and discourages unauthorized vehicles unfettered access to controlled areas except under predetermined conditions.

It is known to provide guarded or unguarded gates at control points of security perimeters to regulate traffic through a controlled number of entrances using a variety of barriers. Known gates include chain link fencing sections, wooden or metal cantilevered and liftable bars, traffic spikes and other generally light-weight obstruction devices. Such devices are typically light in weight to facilitate their operation, increase the speed of actuation between open and closed positions, and to reduce associated wear and tear. Devices that include manned shelters often are constructed on a mobile platform to enable the units to be towed into position and parked, for example the guard shack stations provided by Shelters Direct and Par-Kut Liftable bar-type barriers are typically pivotally mounted at one end to permit their vertically pivoting removal from their intended, access blocking position. One known chain link gate is arranged for guillotine travel up and down. Horizontal rolling chain link gates are often employed at such control points as well. At a manned vehicular access point, a guard shack, or outbuilding is often employed and is situated in proximity to the control locus to provide environmentally-sheltered accommodations to a person tasked with enforcing control of traffic at that location. Once it is determined that the vehicle is suited for access to the secured area, the guard may provide access by temporarily repositioning the entry barriers to permit a vehicle access to the controlled area. In the alternative to a manned position, traffic-control stations may also be user-accessible by key card, RFID devices, keypads or biometric readers or remotely via video surveillance.

Rigorous control of access by vehicles to sensitive areas has become a significant issue especially in view of increasing concerns of property theft and terrorist threats, for example. Since the area to be secured may be only temporary, say because of a temporal event or a construction project, it can be too costly to justify building a permanent vehicle access control installation at each possible entry. There is a need for a fully-contained, cost-effective, re-positionable access control system that can be delivered on-site as a robust, integral unit, quickly deployable, as needed, then capable of being picked up and loaded onto a bed of a vehicle for fast removal when no longer needed at that location. It would be particularly useful if the prefabricated vehicle access control system could also be easily converted into a permanent installation, if desired.

SUMMARY

A unitary, transportable, vehicular traffic control system is disclosed in accordance with an embodiment of the invention. The Vehicle Access Control ("VAC") system is prefabricated in standard sections or customized to a customer's specification and then delivered on-site in a turn-key configuration. The unit is designed to be offloaded from a flatbed of a tractor trailer with a fork truck using lift points or with a boom winch using lifting eyes. The VAC system is fully customizable depending upon the task for which it is deployed and is available in various lengths to suit the application. In practice, the transportable VAC system is spec'ed out according to the customer's specific needs and then delivered to the site for immediate installation onto a previously prepared surface, such as level asphalt or concrete pavement. In the event that the VAC system install site is not suitably level, the unit may be equipped with jack-screws or other leveling devices to stabilize the unit in an operational condition. Unlike other available, wheeled units, once the VAC system is stabilized, it may then be secured to the base upon which it is mounted, which may comprise dirt, gravel, concrete, asphalt or the like, by captive fasteners such as stakes, mounting bolts and the like, methods all known in the art. In addition to vertically stabilizing the VAC system to the base with fasteners, the VAC system may also be secured in place using poured concrete or preformed concrete curbing to provide additional lateral stability and a more permanent appearance. For even more of a permanent traffic control installation, ports may be provided within the decking of the VAC system to permit installation of cementitious material into the base portion of the VAC system, thereby using the integral base as a prefabricated concrete form.

Typically, after the VAC system is installed and fully stabilized it is then connected to suitable utility services given the installed configuration, which may include, without limitation, electric, computer networking, plumbing, climate control and communications. In the alternative, and especially helpful in remote locations, the VAC system may be configured to include its own electrical generator for self-sufficient power.

Once the mission of the VAC system has been fulfilled at a particular installation point, it may then be removed as a whole unit or in sections and then transported to another site or sent to storage with little damage being done to the original installation site.

An object of the present invention is a vehicle access control system. The system includes an elongate, generally hollow, generally planar base platform having a first and a second distal end. A generally hollow enclosure is atop the base platform. A first lift gate is intermediate the enclosure and the first distal end of the base platform, while a second lift gate is intermediate the enclosure the second distal end of the base platform. A first lift arm is pivotally coupled to the first lift gate and extends generally perpendicularly away from a longitudinal axis of the base platform. Likewise, a second, opposing lift arm is pivotally coupled to the second lift gate and extends generally perpendicularly away from the longitudinal axis of the base platform. The base platform is configured for direct contact with a mounting surface. In addition, the vehicle access control system is transportable as a unit.

BRIEF DESCRIPTION OF THE DRAWINGS

Further features of the present invention will become apparent to those skilled in the art to which the present invention relates from reading the following specification with reference to the accompanying drawings, in which.

DETAILED DESCRIPTION

Figure 1:
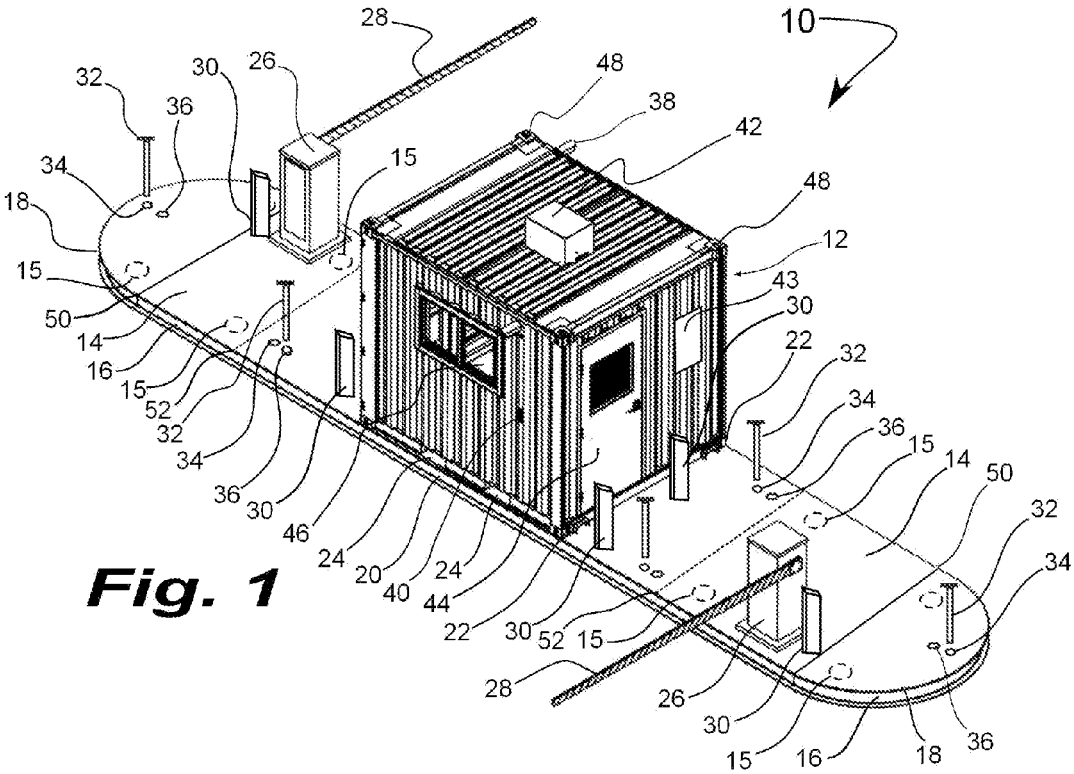
FIG. 1 is a perspective view of a vehicle access control system according to an embodiment of the present invention.
Figure 2:
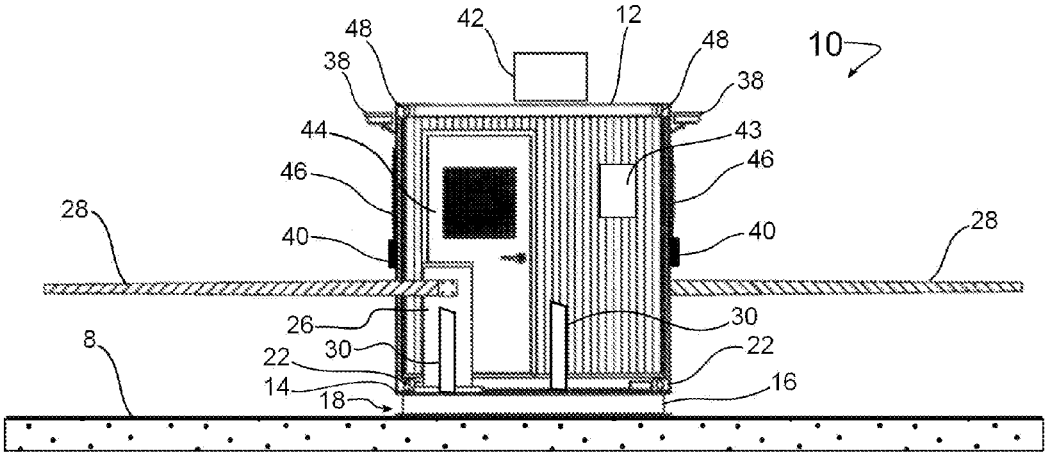
FIG. 2 is a end elevational view of the vehicle access control system depicted in FIG. 1 according to an embodiment of the present invention.
Figure 3:
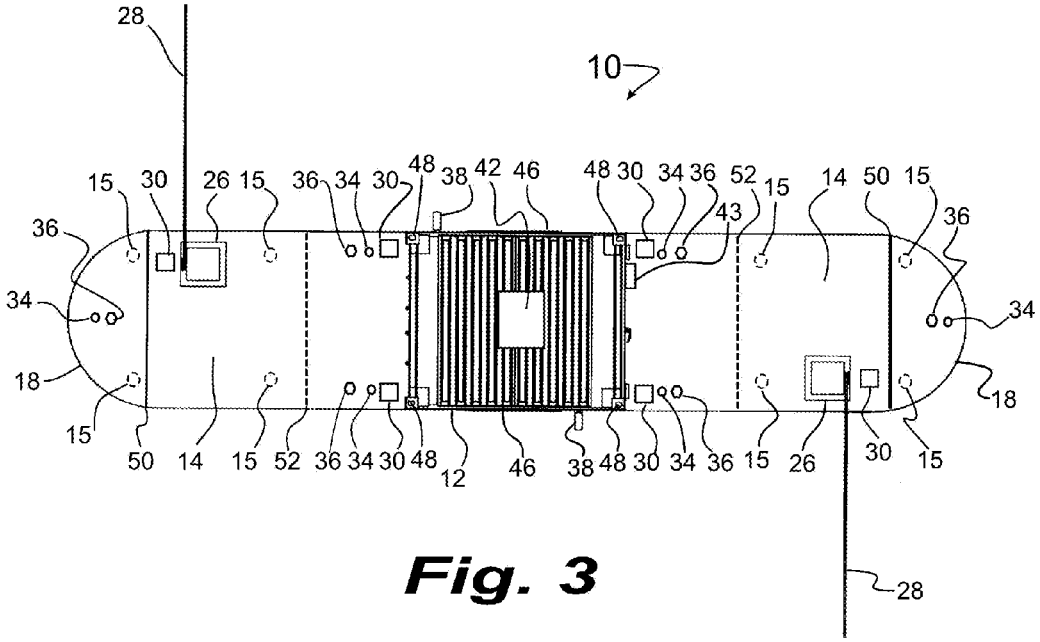
FIG. 3 is a top plan view of the vehicle access control system depicted in FIG. 1 according to an embodiment of the disclosed invention.
Figure 4A:
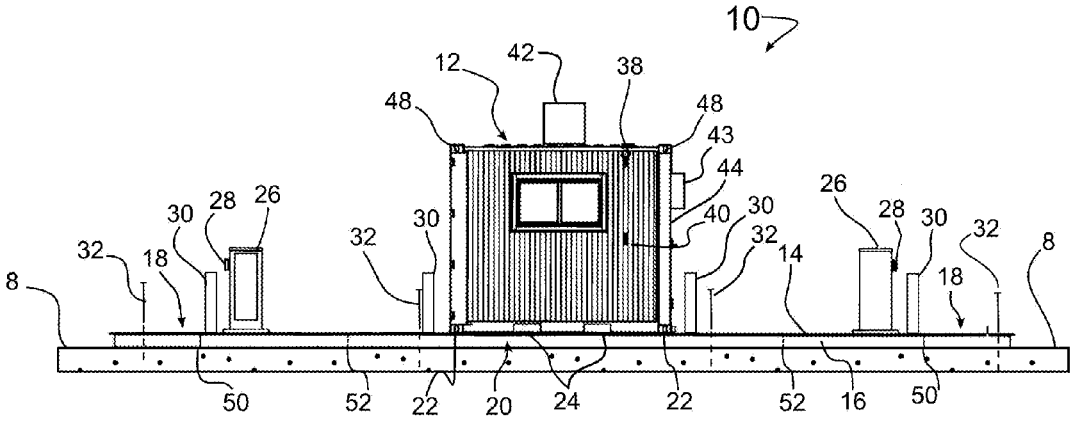
FIG. 4A is a side elevational view of the vehicle access control system depicted in FIG. 1.
Figure 4B:
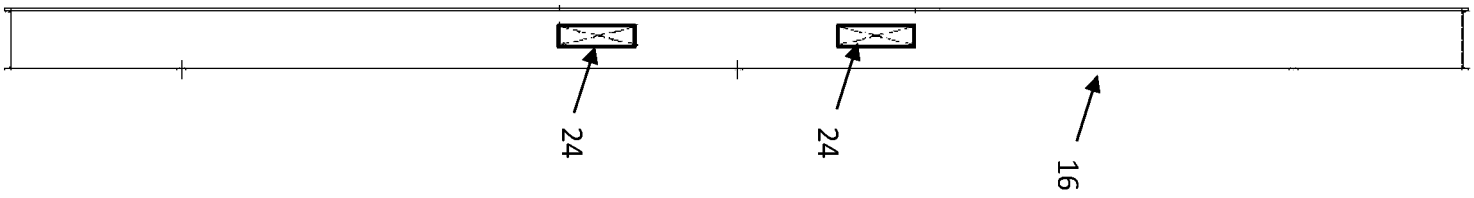
FIG. 4B is an enlarged view of a base platform according to an embodiment of the disclosed invention.

A VAC system 10, according to the disclosed embodiment, provides a quick, environmentally-sensitive (re-usable with a temporary footprint) and cost-effective solution to on-site security and vehicular traffic control. As depicted in FIGS. 1-4, the system 10 may include a guardhouse enclosure 12, such as available from Modular Security Systems, Inc. of Ironton, Ohio, traditional vehicle control (such as lift gates 26) barriers, motion and/or proximity sensors 40 and a lane separating traffic island, formed by VAC system base 16 and deck 14, all coupled into a single, unitary transportable structure that can be delivered on-site, in a fully assembled condition on a flatbed truck and then simply off-loaded into place using a suitable fork truck and fork pockets, as at 24 or using a boom winch and lift eyes 48.

Unlike other mobile or transportable guard houses, such as offered by PAR-KUT International, Inc., the VAC system 10 may be configured to be up to 40 feet long and is not typically outfitted with wheels. This configuration is sized and is suitable for delivery from a standard flatbed trailer. The 40 foot length is suitably sized to control both semi-truck and standard vehicular traffic. Shorter units, such as the PAR-KUT that are mounted on much shorter frames, would not work as effectively on semi-trucks since a standard semi truck is about 12 feet from its bumper to the driver's seat. That would require security personnel to abandon the security of enclosure 12 in order to physically access the credentials of a driver seeking access to a controlled site. This would unnecessarily expose security personnel and/or the secured site to undue security risk and environmental variables. In applications wherein access by only pedestrians or passenger vehicles needs to be controlled, a shorter and lighter (a nominal, 20-foot long) unit may be provided, and is depicted generally in the figures by the dashed line 52. It should be appreciated that shorter configurations would necessarily require a relocation of a number of components closer to enclosure 12 from that which is shown, for example lift gates 26 and one or more access ports 15.

A generally hollow guard house enclosure 12 is secured to the framework (not shown) of the VAC system 10 via anchors 22 using conventional fastening methods. At least one door 44 is provided in the enclosure 12 for access to the interior of the unit by authorized persons. Windows are provided, as at 46, preferably on each side of the enclosure 12 for purposes of good visibility. Opposing windows 46 may be of a sliding variety to enable the guard personnel to engage the drivers of vehicles seeking entry into the controlled site. In addition to housing guard personnel, the enclosure 12 also provides a mounting base for various system components, such as a heating, ventilating and air conditioning (HVAC) unit 42, utility junction box 43, cameras 38, sensors and/or manual access controls 40, such as card readers, key pads, biometric readers and the like.

Another advantage of the VAC system 10 according to the present invention is that it can be preconfigured at the manufacturer facility and delivered fully equipped with access control technologies as specified by the customer and engineered to meet the customer's exacting security and access needs for any given application. Thus the VAC system 10 provides for a turn-key installation and, upon the hookup of any necessary utilities via utility junction box 43, can be rendered fully operational relatively quickly soon after its delivery to the site. According to the disclosed embodiment of the invention, most customer engineering and on-site construction can be eliminated, thus cutting costs and making installation fast and simple. The VAC system 10 may be delivered in a configuration to be manned in situ from the guardhouse 12, or monitored and controlled from a remote location utilizing a variety of manual access controls 40, such as key cards, numeric keypads, biometric reader, cameras 38, duplex communications and/or similar technologies. A single operator manning any number of VAC systems 10 effectively multiplies the utility and cost effectiveness of the installations, thereby offering a sizable savings in both installation and operating costs.

The VAC system 10 may be delivered in a condition ready to tie into a site's pre-existing vehicle access control system, or as a turnkey, "stand alone", self-sufficient system with its own access control computer onboard.

Some of the additional features that may be incorporated into a transportable VAC system may include, without limitation, one or a combination of the following features:

- AC/DC operation
- Access control computers
- Anchoring capability 32, 34
- Ballistic glass package
- Biometric readers
- Blast reinforced walls
- Climate controlled guardhouse enclosure 42
- Corrosion resistant under coatings
- Day light and infrared camera systems 38
- Deck leveling system 36
- Electric generator
- Electronic signage
- Exterior emergency warning lighting
- Exterior siding options such as stone, brick veneer, architectural block
- Exterior speakers
- Flood lighting
- Heated floor or heated deck plate
- Hygiene facilities
- License plate capturing scanners (cameras) 38
- Lifting eyes on top of enclosure 48
- Lifting fork pockets 24 on base
- Motion sensors
- Photo-sensors or light bars
- Proximity or magnetic card readers
- Punch code readers
- Slip resistant rubberized decking 14
- Solar panels Steel or aluminum construction
Thermal imaging
Traffic detection equipment
Vehicle barrier devices 26, 28 (lift arm)
Video recording devices
Wireless networking capability The base platform 16 of the VAC system 10 may be constructed from structural steel, stainless steel, aluminum or other materials having sufficient structural qualities. One embodiment of the invention utilizes rectangular, tubular steel (not shown) to form the base platform 16, although circular or other shaped tubing or structural shapes (such as C-channels, as shown in FIGS. 1, 2, 4A, 4B) may be utilized without departing from the invention. Adjacent structural members are preferably connected to one another either permanently, by welding, bolted tightly together or bolted loosely in sections through slotted portions to permit the platform to move lightly up and down to conform to the profile of the underlying surface material.

Once the base platform 16 is constructed, deck 14 material is applied to cover the substantial or complete portion of the base. The deck 14 may be constructed from patterned (diamond or checker plate) or non-patterned deck plating made from steel, stainless steel, aluminum or other structurally suited material and provides a base for mounting any number of accessories, such as lift gates 26, guardhouse enclosures 12, safety barricades, bollards 30 and the like. In addition, deck 14 may be coated with a slip-resistant coating, such as the Rhino® brand spray coating found in pickup truck beds or other rubberized coating to make it less slippery during inclement weather.

The island portion (14, 16) may comprise one or more middle sections 20 and may include two end sections 18, one at either end and shown abutting at joint 50. Depending upon the application, to secure the VAC system in situ, the base platform 16 may be equipped with a suitable number of ports 34 for coupling stakes 32 or other suitable fastening means with mounting surface 8. Likewise, adjustable leveling devices 36, located at suitable locations about the deck 14 surface, may be provided to orient the horizontal plane of deck 14 relative to the underlying mounting surface 8. Leveling devices may include jack screws or biased leveling legs that move vertically to conform to base 8 profiles. In addition, anchoring nuts (not shown) may be strategically located at predetermined positions about the deck 14 surface for securing accessories to the surface of the VAC system 10, such as lift gate 26, traffic bollards 30 and the like. Access ports 15 are provided at predetermined locations about deck 14 to provide access to the space beneath the deck and between structural members (not shown) of the base platform 16. Access ports 15 may be utilized to pump cementitious materials between the mounting surface 8 and the deck 14 within the perimeter of VAC system 10 base platform 16. In this manner, base platform 16 provides a ready form for the installation of the cementitious material, in the event that a more permanent VAC system 10 installation is desired. Alternatively, a predetermined quantity of cementicious material may be disposed around the periphery of the base platform 16 to form a curb, the curb joining the base platform and the mounting surface 8.

In some alternative embodiments of the present invention the vehicle barrier devices, such as the lift gate 26 and lift arms 28, may be attached directly to the enclosure 12 in lieu of providing suitable space on deck 14 surface. The result is an overall shorter VAC system 10.

From the above description of the invention, those skilled in the art will perceive improvements, changes and modifications in the invention. Such improvements, changes and modification within the skill of the art are intended to be covered.

What is claimed is:

1. A vehicle access control system, comprising:

an elongate, generally hollow, generally planar base platform having a first and a second distal end, the base platform further including a first endwall located at the first distal end, a second endwall located at the second distal end, and a sidewall;

a deck atop the base platform;

a first generally hollow enclosure atop the deck;

a first lift gate intermediate the first enclosure and the first distal end of the base platform;

a second lift gate intermediate the first enclosure the second distal end of the base platform;

a first lift arm pivotally coupled to the first lift gate, the first lift arm extending generally perpendicularly away from a longitudinal axis of the base platform;

a second, opposing lift arm pivotally coupled to the second lift gate, the second lift arm extending generally perpendicularly away from the longitudinal axis of the base platform;

at least one freestanding first bollard extending upwardly away from the base platform intermediate the first lift gate and the first endwall; and at least one freestanding second bollard extending upwardly away from the base platform intermediate the second lift gate and the second endwall, the first bollard and the second bollard configured as safety barricades for the first and second lift gates;

the base platform being configured for direct contact with a mounting surface, the deck, sidewall and mounting surface cooperating to form a second generally hollow enclosure, and the vehicle access control system being configured as a fully assembled structure without wheel-mounting accommodations, the vehicle access control system further being transportable as a unit.

2. The vehicle access control system of claim 1, further comprising:

at least one anchor stake; and at least one anchor port extending through the deck and the base platform, the anchor port being configured to receive the anchor stake, the anchor stake being configured to be coupled to the anchor port, the anchor stake being inserted through the anchor port from the deck and into the mounting surface to secure the base platform to the mounting surface.

3. The vehicle access control system of claim 1, further comprising at least one end cap coupled to at least one of the first and second distal ends of the base platform.

4. The vehicle access control system of claim 1, further including at least one lift eye coupled to the enclosure.

5. The vehicle access control system of claim 1 wherein the base platform further includes:

at least one leveling port; and at least one jackscrew extending through the leveling port and contacting the mounting surface, the jackscrew being selectably adjustable to level the base platform with respect to the mounting surface.

6. The vehicle access control system of claim 1, further including:

at least one access port extending through the deck of the base platform; and a predetermined quantity of cementicious material, the cementicious material being disposed in the hollow portion of the base platform through the access port, the cementicious material joining the base platform and the mounting surface.

7. The vehicle access control system of claim 1, further comprising at least one biasing element extending between the base platform and the mounting surface.

8. The vehicle access control system of claim 1, further including a predetermined quantity of cementicious material disposed around the periphery of the base platform to form a curb, the curb joining the base platform and the mounting surface.

9. The vehicle access control system of claim 1 wherein the first enclosure further includes a door.

10. The vehicle access control system of claim 1 wherein the first enclosure further includes a heating, ventilation and air conditioning system.

11. The vehicle access control system of claim 1 wherein the first enclosure further includes at least one window.

12. The vehicle access control system of claim 1, further comprising a traffic sensor.

13. The vehicle access control system of claim 1, further comprising a manual access control.

14. The vehicle access control system of claim 1 wherein the first endwall is welded to the sidewall at the first distal end and the second endwall is welded to the sidewall at the second distal end.

15. The vehicle access control system of claim 1 wherein the sidewall is a continuous sidewall surrounding the base platform.

16. The vehicle access control system of claim 15 wherein the second enclosure is configured as a containment enclosure.

17. A vehicle access control system, comprising:

an elongate, generally hollow, generally planar base platform having a first and a second distal end, the base platform further including a first endwall located at the first distal end, a second endwall located at the second distal end, and continuous sidewall channel, the continuous sidewall channel including at least two spaced-apart lifting fork pocket openings;

a deck atop the base platform;

a first generally hollow enclosure atop the deck;

a first lift gate intermediate the first enclosure and the first distal end of the base platform;

a second lift gate intermediate the first enclosure and the second distal end of the base platform;

a first lift arm pivotally coupled to the first lift gate, the first lift arm extending generally perpendicularly away from a longitudinal axis of the base platform;

a second, opposing lift arm pivotally coupled to the second lift gate, the second lift arm extending generally perpendicularly away from the longitudinal axis of the base platform;

at least one freestanding first bollard extending upwardly away from the base platform intermediate the first lift gate and the first endwall; and at least one freestanding second bollard extending upwardly away from the base platform intermediate the second lift gate and the second endwall, the first bollard and the second bollard configured as safety barricades for the first and second lift gates;

the base platform being configured for direct contact with the mounting surface, the deck, sidewall and mounting surface cooperating to form a second generally hollow enclosure, and the vehicle access control system being configured as a fully assembled structure without wheel-mounting accommodations, the vehicle access control system further being transportable as a unit.

18. The vehicle access control system of claim 17 wherein the base platform further includes:

at least one leveling port; and at least one jackscrew extending through the leveling port and contacting the mounting surface, the jackscrew being selectably adjustable to level the base platform with respect to the mounting surface.

19. A method for controlling vehicle access, comprising the steps of:

obtaining an elongate, generally hollow, generally planar base platform having a first and a second distal end, the base platform further including a first endwall located at the first distal end, a second endwall located at the second distal end, and a continuous sidewall surrounding the base platform;

placing a deck atop the base platform;

placing a first generally hollow enclosure atop the deck;

locating a first lift gate intermediate the enclosure and the first distal end of the base platform;

locating a second lift gate intermediate the enclosure and the second distal end of the base platform;

pivotally coupling a first lift arm to the first lift gate, the first lift arm extending generally perpendicularly away from a longitudinal axis of the base platform; and pivotally coupling a second, opposing lift arm to the second lift gate, the second lift arm extending generally perpendicularly away from the longitudinal axis of the base platform;

extending upwardly away from the base platform at least one freestanding first bollard located intermediate the first lift gate and the first endwall; and extending upwardly away from the base platform at least one freestanding second bollard located intermediate the second lift gate and the second endwall, the first bollard and the second bollard configured as safety barricades for the first and second lift gates;

contacting the base platform directly with a mounting surface, the sidewall extending away from the deck, the deck, sidewall and mounting surface cooperating to form a second generally hollow enclosure, and the vehicle access control system being configured as a fully assembled structure without wheel-mounting accommodations, the vehicle access control system further being transportable as a unit.

* * * * *